US006079087A

United States Patent [19]

Cansler

[11] Patent Number: 6,079,087

[45] Date of Patent: Jun. 27, 2000

[54] METHOD FOR MAKING WAVY TAPERED BRUSH BRISTLES

[76] Inventor: Ronald Cansler, 3279 Patuxent River Rd., Davidsonville, Md. 21035

[21] Appl. No.: 08/795,802

[22] Filed: Feb. 5, 1997

[51] Int. Cl.[7] ..... D02G 1/14

[52] U.S. Cl. ..... 28/279; 28/247

[58] Field of Search ..... 28/278, 279, 280, 28/217, 219; 19/66.2; 264/286

[56] References Cited

U.S. PATENT DOCUMENTS

| | | | |
|---|---|---|---|
| 940,630 | 11/1909 | Wyman | 19/66.2 |
| 2,508,489 | 5/1950 | Browne et al. . | |
| 2,508,799 | 5/1950 | Reis, Jr. . | |
| 3,217,377 | 11/1965 | Baer et al. | 28/279 |
| 3,396,445 | 8/1968 | Hopkins et al. | 28/279 |
| 4,307,478 | 12/1981 | Ward et al. . | |
| 4,365,642 | 12/1982 | Costa . | |
| 4,381,325 | 4/1983 | Masuda et al. . | |
| 4,979,274 | 12/1990 | McCullough, Jr. . | |
| 5,161,555 | 11/1992 | Cansler et al. . | |

FOREIGN PATENT DOCUMENTS

| | | |
|---|---|---|
| 196 15 098 | 10/1997 | Germany . |
| 598821 | 2/1948 | United Kingdom . |
| WO 98/00049 | 1/1998 | WIPO . |

*Primary Examiner*—John J. Calvert
*Assistant Examiner*—Larry D. Worrell, Jr.
*Attorney, Agent, or Firm*—Caesar, Rivise, Bernstein, Cohen & Pokotilow, Ltd.

[57] ABSTRACT

A machine makes tapered and also uniformly waved bristles for brushes, especially useful for paint brushes, by a method of applying uniform crimping pressure to crimp straight tapered bristles between two crimping gears (20, 30) having mating indentations. The spacing between the crimping gears is freely variable but the force is generally constant. This results in a wave amplitude that is constant over the length of each bristle regardless of the taper. The "floating" constant-force crimping pressure may be provided by weight biasing or electronic control. Tapered wavy filaments brushes employing such filaments and methods of forming such filaments also constitute a part of this disclosure.

3 Claims, 2 Drawing Sheets

METHOD FOR MAKING WAVY TAPERED BRUSH BRISTLES

FIELD OF THE INVENTION

The present invention relates to synthetic brush bristles made from thermoplastic polymers, especially for paint brushes, and more especially to brush bristles which are both tapered and wavy, brushes employing such bristles, and a method and apparatus for making such bristles.

Reference throughout this application to "brush bristle(s)", "brush fiber(s)", or "brush filament(s)", unless more specifically limited, includes bristles(s), fibers(s) or filament(s) employed in any type of brush; both material-applicator brushes (e.g., paint brushes, mascara brushes, blusher brushes, tooth brushes) and brushes that are not employed to apply a material, (e.g., scrub brushes, dust brushes). In the preferred embodiments of this invention the brush bristles, fibers, or filaments are employed in material-applicator brushes, and most preferably are employed in paint brushes.

BACKGROUND OF THE INVENTION

Non-straight synthetic filaments, especially those made wavy by crimping or the like, have been made for a variety of purposes, e.g., for brush bristles of various types (e.g., see Cansler et al U.S. Pat. No. 5,161,555), but mostly for carpet and textile fibers in order to simulate natural fibers.

The conventional fiber crimping machine employs a pair of intermeshing gears with mating teeth or indentations. The gears are set at a fixed distance apart so that the teeth do not "bottom out", but rather a gap is maintained to accommodate the thickness of the synthetic fibers or monofilaments fed between the gears. If the fibers are of thermoplastic material, the gears may be heated to soften the fibers before or while they are between the meshing teeth. Such methods are described for example in the McCullough et al U.S. Pat. No. 4,979,274, which is herein incorporated by reference. This patent shows an apparatus which is adaptable for different fiber thicknesses by interchanging the crimping teeth (FIG. 2).

In the days when most paints were made with organic solvents (not water-based), natural hog bristles, which are both wavy and tapered, were used in the best and most expensive paint brushes, in spite of the fact that they wore out quickly. Natural hog bristles are less used now because water-based paints constitute about 90–95% of the paints on the market, and hog bristles are highly hygroscopic; if used with water-based paints they swell and the brush becomes unsatisfactory. Thus, synthetic bristles have largely replaced natural bristles, especially in paint brushes. Synthetic paint brush bristles outwear natural hog bristles by a factor as much as 10 to 1.

Non-wavy (e.g., uncrimped), synthetic tapered bristles are employed today in better synthetic paint brushes, and level (i.e., non-tapered), waved or wavy synthetic bristles are employed in specialty applicator brushes other than paint brushes, e.g., mascara and blusher brushes. The prior art does not teach or suggest forming or employing wavy, tapered, synthetic brush bristles in brushes of any type, including the preferred material-applicator brushes of this invention, and clearly does not teach or suggest forming or employing wavy, tapered synthetic brush bristles wherein the amplitude of the wave is substantially uniform.

U.S. Pat. No. 4,381,325 to Masuda et al. illustrates tapered filaments that are also slightly waved (e.g., FIGS. 9*b* and 9*c*) over a portion of their lengths; with the wave lacking a constant amplitude. Although the Masuda patent teaches at col. 6, lines 8–13 that crimped filaments can be employed in textile fabrics, if necessary, the Masuda patent also specifically teaches at col. 5, lines 54–58 that waved filaments should not be employed as brush bristles. Thus the Masuda patent teaches away from the present invention.

U.S. Pat. No. 2,508,799 to Reis shows brush bristles which are tapered, are of asymmetrical cross section, and have a changing cross section (see col. 4, line 46). No waving is disclosed. Also see Ward et al U.S. Pat. No. 4,307,478.

Costa, U.S. Pat. No. 4,365,642, shows bristle-like protuberances on a molded mascara applicator which appear to be tapered and also curved (FIGS. 2–6). However, the curves are too short—less than a complete cycle—to be classified as "waves" or to disclose any wave characteristics, including uniform amplitude.

Browne et al, U.S. Pat. No. 2,508,489, shows a crimping machine which adjusts to different thicknesses of fiber (col. 1, line 41). Crimping force is applied by a spring (col. 6, line 16).

The conventional crimping machines described above, which crimp fibers between intermeshing gear teeth with a constant clearance, are not satisfactory for producing uniform waviness in tapered bristles. It has been found that when tapered fibers are fed through such a conventional machine, the thicker ends of the fibers come out more wavy (i.e., with a greater amplitude) than the thinner ends. Insofar as is known, no solution to this problem has been found previously.

In addition to the fact that those skilled in the art did not know how to produce a wavy and tapered bristle, it also has been thought that, even if crimped and tapered bristles could be achieved, brush bristles, and in particular a paint brush formed from such bristles might not be satisfactory because it would be too bulky, the waves might interfere with traditional brush making techniques, or the paint brush might look different and not be acceptable to consumers. This prior art thinking is reflected in the earlier-discussed Masuda '325 patent, which specifically teaches that even the partially waved filaments disclosed therein should not be used for brushes of any type, including paint brushes.

OBJECTS AND SUMMARY OF THE INVENTION

One object of the invention is overcome deficiencies in the prior art, such as mentioned above.

The present invention thus provides a thermoplastic synthetic tapered and wavy brush bristle; preferably an applicator brush bristle, and most preferably paint brush bristles, for the first time. In fact, bristle in accordance with the most preferred embodiments of this invention, when assembled in a paint brush provide excellent paint holding capabilities and excellent paintout results.

Thus, another object of the invention is to provide brush bristles having excellent applicator properties, and most specifically, paint applicator properties.

It is a further object of this invention to provide a reliable method and apparatus for making wavy tapered synthetic brush bristles in accordance with this invention.

A highly desirable attribute of the most preferred form of the invention is that the wave amplitude remains substantially constant over the working length of the brush bristles. To achieve this object, the brush bristles of the present invention are made by passing the tapered bristles through the nip between conventional crimping gears, but with one very important difference from the conventional. If these gears were set up in the usual way, the butt end of the bristle would have a greater wave amplitude than the tip end because the gap or nip between the gears would be constant and the thicker portion of the bristle would be deformed to a greater extent.

In a preferred embodiment, the present invention permits the upper crimping gear to "float". It has been determined that for polyester bristles and nylon 6/12 bristles, the crimping force may most simply be applied by the weight of the upper crimping gear and its support, which may be approximately 50–100 pounds to provide the desired degree of "float" and thus the desired wave amplitude. It is preferred that a weight be not less than 20 pounds nor more than 200 pounds. Routine testing can determine the optimum force for any particular polymer species, taking into account the degree of taper and the maximum and minimum monofilament diameters.

The invention also contemplates a more complicated system which, by means of sensitive electronic equipment, senses the diameter of the continuous filament immediately upstream of the crimping rolls and then adjusts the gap between the crimping rolls to provide the desired amplitude.

BRIEF DESCRIPTION OF THE DRAWING

The above and other objects and the nature and advantages of the present invention will become more apparent from the following detailed description of an embodiment[s] taken in conjunction with the following drawings, wherein.

DETAILED DESCRIPTION OF THE PREFERRED EMBODIMENT

Figure 1:
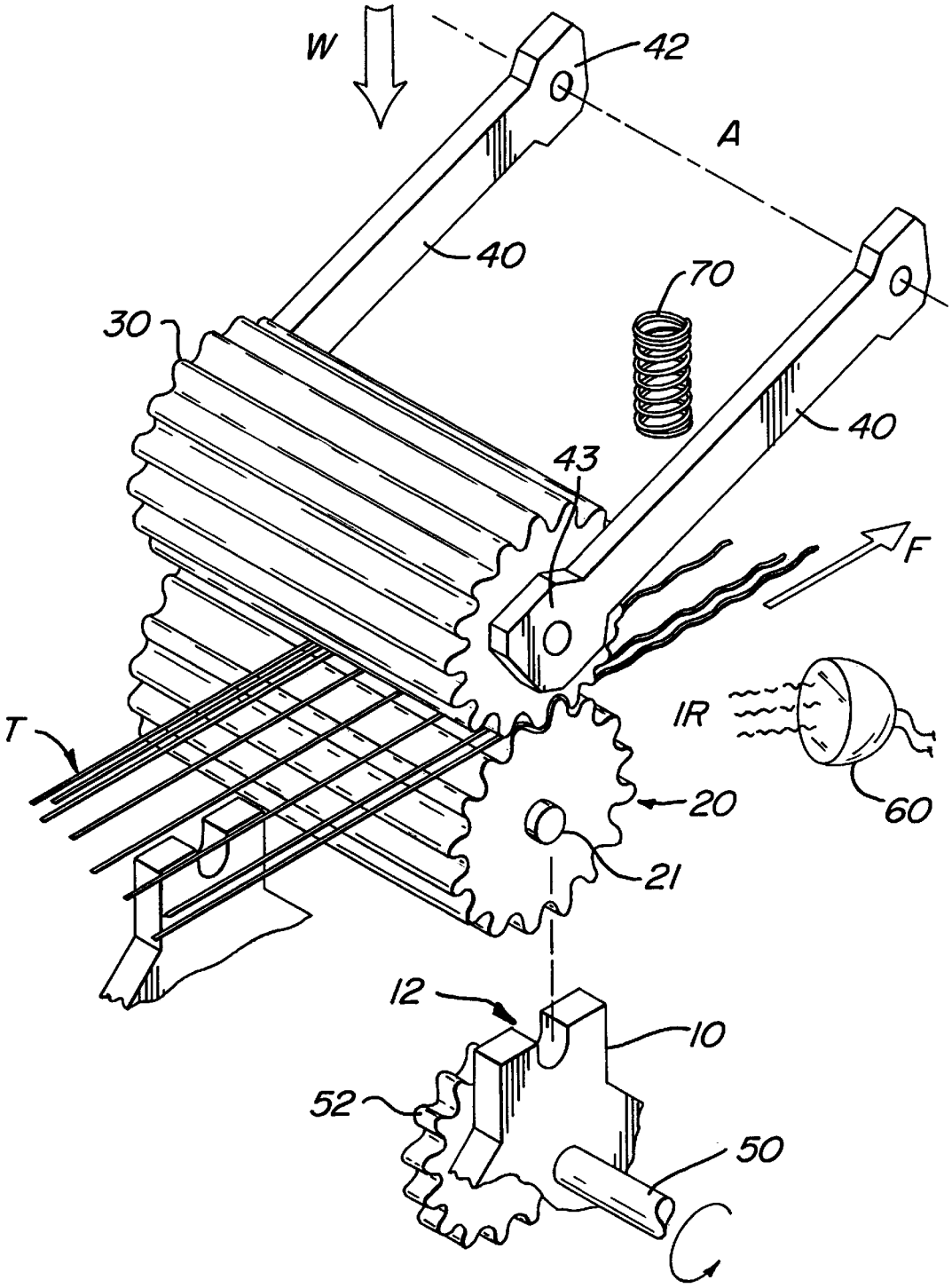
FIG. 1 is an isometric, partially exploded, and partially schematic view of a system for making bristles according to the present invention.

FIG. 1 shows a crimping machine according to the present invention. A tow T of preferably 20 to 450 continuous filaments is passed between two indented rollers with intermeshing teeth, commonly called crimping gears. A lower crimping gear 20 includes axial bearing protrusions 21 at either end, which fit into journals 12 in frame blocks 10 at either end. The lower crimping gear 20 is shown exploded out of the journals 12 for clarity, and to show that the crimping gear 20 is removable.

The tow T includes monofilaments which are tapered, changing in diameter between narrow and thick portions along their lengths. The tow T may come directly from an annealing oven (not shown) which would be off the left side of the drawing, or from a cooling bath after the tow has been extruded, stretched and drawn according to known practice. The tow T is crimped after passing between the two crimping gears 20 and 30, and the tow with crimped monofilaments continues onward toward the right, preferably being kept under tension by a force F (indicated by an arrow in the drawing). The crimped fibers may also be allowed to fall onto a conveyor belt, and then passed into an annealing oven or the like, or receive other conventional treatment such as that shown by the incorporated McCullough et al. '274 patent. The monofilaments are then cut to suitable bristle lengths downstream (not shown) in a convention manner.

As shown in FIG. 1, the upper crimping gear 30 is arranged to intermesh with the lower crimping gear 20. As the tow T passes through the nip, the monofilaments are compressed between the crimping gears 20 and 30 and deformed to impart the desired crimp or waviness.

In the present invention at least one of the gears, preferably the upper gear 30 for simplicity, "floats". The gap or nip between the two crimping gears 20 and 30 is not fixed; instead, the force between the gears tends to be fixed, and the gap takes whatever value it will, or else the gap is controlled in such a way that the inter-gear compression force tends to be constant. In either event, the gap between the gears 20 and 30 varies in size in accordance with the varying transverse dimension of the tapered filaments of the tow T.

In the particular embodiment shown in the drawing, the upper crimping gear 30 is rotatably held in a cradle comprising two arms 40, which at their respective ends distal the crimping gear 30 are each rotatable about a rotation axis A. The arms 40 include a bearing surface 43 in which the upper crimping gear 30 rotates; in the illustrated embodiment the gear 30 rotates freely rather than being driven, but driving is a option. Instead of swing arms or a swing arm, other conventional arrangements like slide tracks can also be used.

The compressing force between the lower crimping gear 20 and the upper crimping gear 30 is, in the illustrated embodiment, due to downward force of the upper gear 30 onto the fixed lower gear 20. The force is preferably supplied by gravity weight W (shown by an arrow in FIG. 1), that is by the weight of the arms 40 and gear 30; but the force W may also be augmented (or, diminished) by a mechanical device such as a spring 70, acting between the arm 40 and the same frame that supports the frame blocks 10 (the frame is not shown in the drawing). Other conventional force devices may also be used, such as for example hydraulic cylinders, pneumatic bags, elastic blocks, magnetic or electromagnetic devices, and so on. Additional weights (not shown) may be attached or levered to the arms 40 or gear 30. If the tow T is to move in a vertical or inclined direction, then similar means for forcing the gears 20 and 30 together may be used; for example, the arms 40 may include an extension at an angle to the main arm with a weight at the end, which would tend to rotate the gear 30 even if it were disposed under the axis A.

The lower crimping gear 20 is freely rotatable in the journals 12, as is the upper crimping gear 30 in the bearings 43. The tow tensioning force F, if it is not sufficient to turn the crimping gears 20 and 30, may be augmented by a drive gear 52 taking power from a shaft 50 turned by a conventional rotor, e.g. an electric motor (not shown). Alternatively, the upper gear 30 may be driven; both gears may be driven; or both be driven simultaneously through conventional means which may include extra gears axial with the crimping gears 20 or 30, pulleys, and so on. The tension force F should not be large enough to separate the crimping gears 20 and 30.

The temperature of the tow T and the crimping gears 20 and 30 may be controlled, if desirable, either directly or indirectly. Indirectly, the temperature of the tow T at the crimping gap where the lower gear 20 meshes with the upper gear 30 will be a function of the temperature of the tow T as it comes from an annealing oven or other device off the left and upstream side of FIG. 1, friction, and the ambient temperature. The temperature may be controlled directly, for example by a heat lamp 60 directing infrared radiation IR at the tow T preferably on the upstream side of the crimping gap, or at the gears 20 and/or 30. The gears may of course also be heated (or cooled) by other conventional means like vented air, internal electric resistance heaters, and so on.

Beside crimping gears, other machine elements may be used to exert a uniform crimping force on the tow T. For example, belts or tracks with mating indentations could hold the tow T in the indentations between them over a track length, and so exert the crimping force for a longer period of time as the same tow advance rate. The force application time could also be increased by passing the tow between the intermeshing teeth of a planetary gear set, that is, between one crimping gear like that of FIG. 1 and another of larger diameter with internal teeth. Other arrangements are also within the scope of the invention.

Two examples of bristles of the present invention which have been produced for experimental purposes are:

(1) tapered round polyester "waved" bristles of 3.5inches length having a butt end diameter of 9 mils and a tip end diameter of 5 mils; and (2) tapered round polyester "waved" bristles of 3.25 inches length having a butt end diameter of 12 mils and a tip end diameter of 8 mils.

Figure 2:
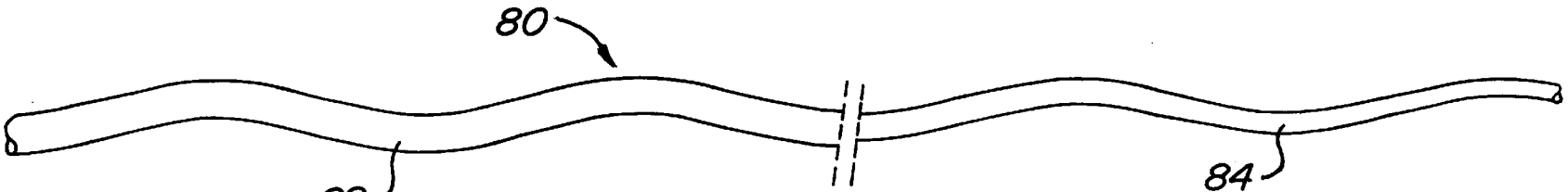
FIG. 2 is a broken apart enlarged plan view of a fiber according to the invention.
Figure 3:
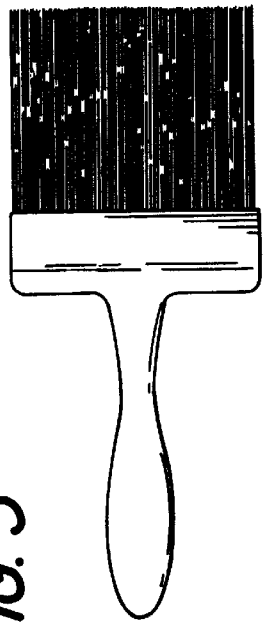
FIG. 3 is a perspective view of a paint brush according to the invention.

FIG. 2 is an enlargement based on photomicrographs of an example fiber 80 for a paint brush produced according to the present invention, showing at the left side of the figure the thicker portion 82 near the butt end of the tapered bristle 80, and at the right a thinner portion 84 near the tip end. This figure is broken apart with the central portion of the bristle 80 being omitted because the length of the bristle is so great relative to its tapered diameter and the degree of wave, that the bristle 80 cannot be accurately shown to scale on the sheet provided. However, the figure illustrates that the waviness is constant (i.e., substantially uniform amplitude) along the length of the bristle, even as the bristle diameter varies.

The paint brush bristles of the present invention are provided in typical lengths of 1.5 to 5.5 inches and in diameters preferably ranging from 4–10 mils at the tip end and 7–18 mils at the butt end; that is, the exemplary butt diameter to tip diameter ratios are 7:4 to 18:10. The preferred ratio of butt end diameter to tip end diameter range is about 1.8:1.0, but may depart widely from this value.

The waviness imparted to these tapered synthetic bristles, which may desirably be formed of polyesters, preferably PET and PBT, or of polyamides, preferably nylon 6/12, is preferably of a frequency of 4.5–8 waves per inch, most preferably 5–7 waves per inch, although it is possible to provide frequencies outside these ranges.

The wave amplitude, measured from opposite sides of the bristle, may be selected from a value within the range of 2–20 mils, but is preferably selected from a value within the range of 3–11 mils. Most preferably, the amplitude is maintained substantially constant.

The tapered and wavy brush fibers or bristles of this invention may be used in a variety of brush applications, with the preferred uses being in applicator brushes, e.g., paint brushes, mascara brushes, blusher brushes, toothbrushes, etc. Most preferably the brush fibers or bristles of this invention are employed in a paint brush either alone or in a mixture with other bristles, e.g., 5–95% and more preferably 20–80% when used with other bristles. Most preferably, the tapered wavy bristles of this invention are of a uniform wave (i.e. a uniform amplitude), which is a construction that has not been achieved in prior art tapered bristles or filaments.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein, unless specifically indicated to the contrary, is for the purpose of description and not of limitation.

What is claimed is:

1. A method of making tapered synthetic bristles each having a substantially uniform wave amplitude regardless of varying bristle cross section along a length thereof, comprising passing a tow of monofilaments which vary in cross section along the length thereof between a first member corrugated with first indentations and a second member corrugated with second indentations matable with said first indentations; and crimping, with uniform crimping pressure regardless of said varying diameter, said monofilaments between the indentations of said first member and the indentations of said second member in an aligned juxtaposition of said first and second members, and thereby imparting to each portion of each monofilament a uniform wave amplitude regardless of monofilament cross section.

2. The method according to claim 1, including a step of heating at least one of the tow, the first member, and the second member.

3. The method according to claim 1, including a step of weighting at least one of the first member and the second member.

* * * * *